US010690020B2

(12) United States Patent
Barber

(10) Patent No.: US 10,690,020 B2
(45) Date of Patent: Jun. 23, 2020

(54) VERTICAL SLIDING VALVE ARM

(71) Applicant: Michael D. Barber, Loma Linda, CA (US)

(72) Inventor: Michael D. Barber, Loma Linda, CA (US)

( * ) Notice: Subject to any disclaimer, the term of this patent is extended or adjusted under 35 U.S.C. 154(b) by 0 days.

(21) Appl. No.: 16/673,870

(22) Filed: Nov. 4, 2019

(65) Prior Publication Data

US 2020/0063610 A1 Feb. 27, 2020

Related U.S. Application Data

(63) Continuation-in-part of application No. 15/731,275, filed on May 16, 2017, now Pat. No. 10,465,570.

(60) Provisional application No. 62/391,072, filed on Apr. 18, 2016, provisional application No. 62/391,982, filed on May 16, 2016.

(51) Int. Cl.

| | |
|---|---|
| ***F01L 1/46*** | (2006.01) |
| ***F01L 1/047*** | (2006.01) |
| ***F01L 1/14*** | (2006.01) |
| ***F01L 3/10*** | (2006.01) |
| ***F01M 9/10*** | (2006.01) |

(52) U.S. Cl.

CPC ..... *F01L 1/465* (2013.01); *F01L 1/047* (2013.01); *F01L 1/146* (2013.01); *F01L 3/10* (2013.01); *F01M 9/10* (2013.01)

(58) Field of Classification Search

CPC . F01L 1/047; F01L 1/146; F01L 1/462; F01L 5/045; F01L 7/02

See application file for complete search history.

(56) References Cited

U.S. PATENT DOCUMENTS

| | | | | |
|---|---|---|---|---|
| 1,309,339 | A * | 7/1919 | Reynolds | F01L 1/16 123/90.47 |
| 4,308,828 | A * | 1/1982 | Kinsel | F01L 1/46 123/90.24 |
| 6,234,126 | B1 * | 5/2001 | Kaye | F01L 1/00 123/65 VD |
| 7,146,948 | B1 | 12/2006 | Eells | |
| 7,603,971 | B2 * | 10/2009 | Allen | F01L 13/0021 123/90.16 |
| 8,033,261 | B1 | 10/2011 | Robbins | |
| 10,465,570 | B1 * | 11/2019 | Barber | F01L 1/182 |

* cited by examiner

*Primary Examiner* — Ryan A Reis

(74) *Attorney, Agent, or Firm* — Kirk A. Buhler; Buhler & Associates Patenting

(57) ABSTRACT

Improvements in a vertical sliding valve arm has been disclosed with systems and methods related to eliminating the common pivot-type rocker arm and reversing the use of the valve spring in internal combustion engines. More specifically, the camshaft lobes activate a sliding valve arm to close the engine valve instead of opening it and the valve spring is used to push open the valve instead of closing it.

18 Claims, 8 Drawing Sheets

VERTICAL SLIDING VALVE ARM

CROSS REFERENCE TO RELATED APPLICATION

This application is a continuation-in-part of applicant's co-pending application Ser. No. 15/731,275 filed May 16, 2017, that claims priority to provisional application 62/391,072 filed Apr. 18, 2016, and provisional application Ser. No. 62/391,982 filed May 16, 2016, which is hereby expressly incorporated by reference herein

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an engine valve. In More particularly, the present vertical sliding valve arm is activated by the camshaft to close the corresponding valve and a valve spring to open the valve.

Description of Related Art Including Information Disclosed Under 37 CFR 1.97 and 1.98

The current way to close an engine valve is to use a spring. This is not desirable because of the dynamic motion in engines, which may cause spring wear and various valve train problems that lead to poor power transmission and poor fuel consumption rates. Valve float is one of the valve train problems and refers to the inability of the valve lifter to properly follow the contour of the camshaft when the engine is operating at high speeds. Since the valve actuation is not aligned with the shape of the camshaft lobe, this may result in catastrophic failure or engine damage if the closing valve makes contact with the piston. The other consequences are valve spring harmonics and vibrations that cause the valve to bounce on its seat while trying to open and close. Pivoting rocker arm and valve spring failure is another common malady in high-performance racing engines. Therefore, it is advantageous to employ engine valve actuation that does not require pivoting rocker arms and valve springs for valve closure.

This present invention eliminates or minimizes these problems by using the camshaft lobe at its peak to close the engine valve with positive linkage through the pushrod. Valve float is minimized along with the chance of a piston hitting the engine valve as a result of an engine valve staying open for too long due to weak or malfunctioning valve springs. Another benefit of this invention is more precise valve timing events with custom ground valve float refers to a scenario where the valve actuation is not aligned with the shape of the camshaft lobe and may result in catastrophic failure if the closing valve makes contact with the piston. Pivoting rocker arm and valve spring failure is another common malady in high-performance racing engines. Therefore, it is advantageous to employ valve actuation that does not require pivoting rocker arms and valve springs for valve closure One approach is to use springless valves known as desmodromic valves. Desmodromic valve systems use extra cam lobes on the camshaft to close the valves via pivoting rocker arms. Springs are thereby eliminated and the potential for valve float or broken springs is removed. However, desmodromic valves are costly, labor-intensive, and difficult to mass produce.

One such desmodromic design is U.S. Pat. No. 8,033,261. The lifter in this patent provides additional support and is offset. This requires the lifter for the rocker arm to be at a 90-degree angle, which in turn requires extensive modification to an existing cylinder block to position the lifter at a 90-degree angle to the camshaft. The intermediate rocker is caused to oscillate on its free-turning support shaft.

The present invention uses a vertical sliding valve arm activated by the camshaft to close the corresponding valve and a valve spring to open the valve. This is in contrast to conventional engines, which use the camshaft lobes to open a valve and the valve spring to close it. The present invention comprises in part a retrofitting system requiring little machine work on an existing engine.

BRIEF SUMMARY OF THE INVENTION

The vertical sliding valve arm relates to cylinder valve actuation occurring within internal combustion engines or motors whereby valve springs and pivot rocker arms are the standard for causing, in part, cylinder valve closing. The vertical sliding valve arm eliminates the common pivot-type rocker arm and reverses the use of the valve spring whereas the camshaft lobes activate a sliding valve arm to close the engine valve instead of opening it and the valve spring is used to push open the valve instead of closing it.

It is therefore an object of the vertical sliding valve arm to eliminate the conventional pivot rocker arm to achieve valve actuation and relatedly, to eliminate the problems associated with valve float in high rpm motors.

It is another object of the vertical sliding valve arm to reduce or eliminate stress valve train components.

It is another object of the vertical sliding valve arm to reduce friction on engine components.

It is another object of the vertical sliding valve arm to improve fuel consumption rates.

It is another object of the vertical sliding valve arm to decrease the reciprocation weight off the camshaft and drive gears, and valve train.

It is another object of the vertical sliding valve arm to decrease valve spring pressures resulting in less wear on engine components.

It is another object of the vertical sliding valve arm to use more precise valve timing on the camshaft lobe profiles.

It is another object of the vertical sliding valve arm to reduce or eliminate valve train parts breakage due to valve float.

It is another object of the vertical sliding valve arm to introduce a new camshaft profile that will upon it, apex or peak close the engine valves instead of opening them.

The characteristics and utilities of the vertical sliding valve arm described in this summary and the detailed description below are not all inclusive. Many additional features and advantages will be apparent to one of ordinary skill in the art given the following detailed description.

There has thus been outlined, rather broadly, the more important features of the invention in order that the detailed description thereof that follows may be better understood, and in order that the present contribution to the art may be better appreciated.

In this respect, by explaining at least one embodiment of the invention in detail, it is to be understood that the invention is not limited in its application to the details of construction and to the arrangements of the components set forth in the description. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may be utilized as a basis for the design of other structures, methods, and systems for carrying out the purposes of the present invention. It is important, therefore, that the description be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers, and practitioners who are not familiar with patent or legal terms or phraseology, to determine quickly from a cursory inspection, the nature and essence of the technical disclosure of the application. The abstract is neither intended to define the invention of the application, nor is it intended to be limiting as to the scope of the invention in any way.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 1, which shows the preferred embodiment with the sliding arm mounted on the cylinder head.

DETAILED DESCRIPTION OF THE INVENTION

Figure 1:
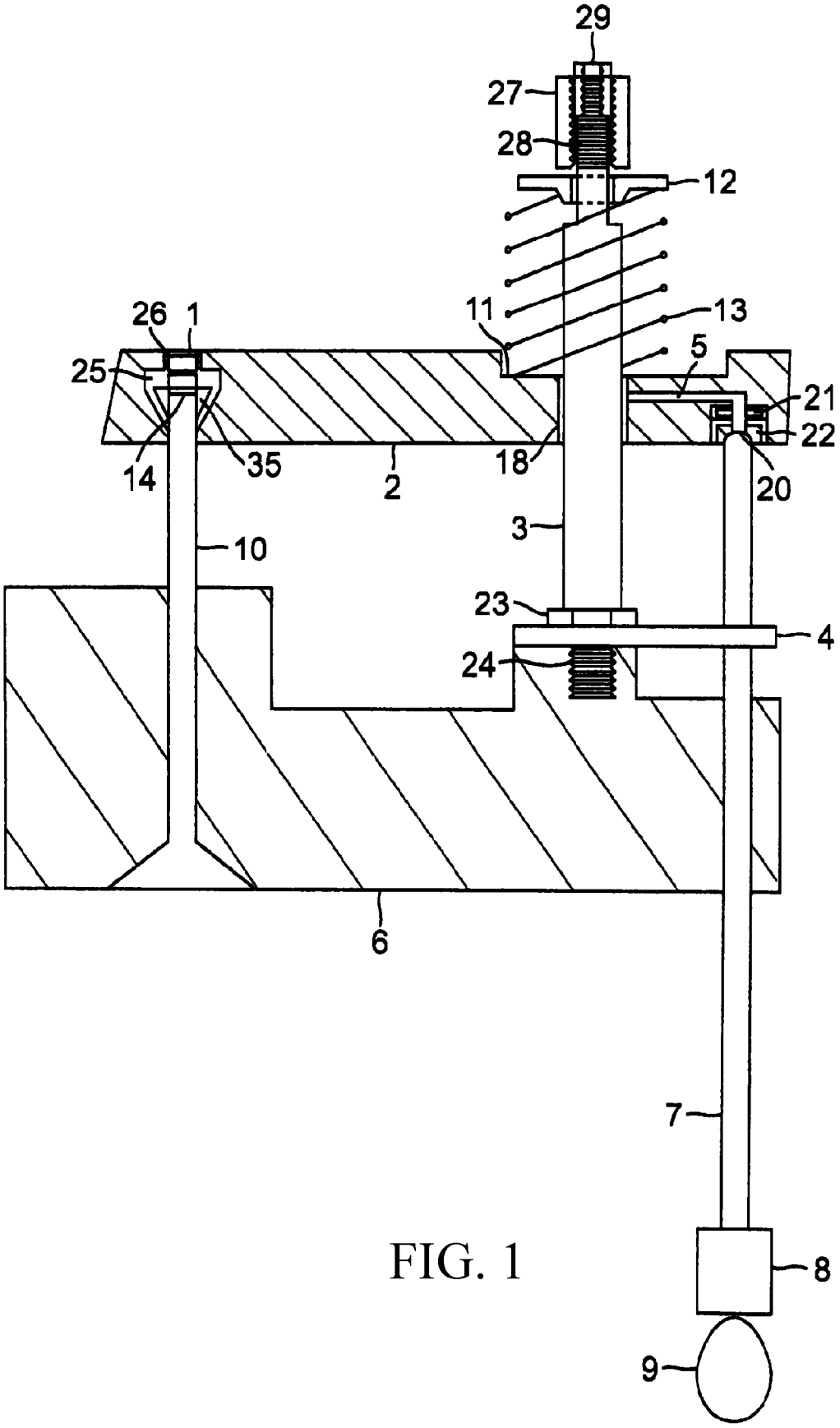

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

| Item Numbers and Description | |
|---|---|
| 2 sliding arm | 3 sliding arm post |
| 4 guide plate | 5 passage |
| 6 cylinder head | 7 pushrod |
| 8 lifter | 9 camshaft |
| 10 engine valve | 12 valve retainer |
| 13 valve spring | 18 bushing |
| 19 fasteners | 20 pushrod piston |
| 21 compressible material | 22 bore |
| 25 cavity | 28 threaded stem |
| 30 body | 31 holder |
| 32 trunnion adapter | 33 trunnion |
| 35 valve locks | 36 check valve |
| 37 supply line | 38 cylinder |
| 39 valve | 40 piston |
| 41 piston rod | 42 arm |
| 43 pivot roller | 45 pivot roller |
| 46 roller arm | 50 body |
| 51 sliding arm roller | |

The vertical sliding valve arm uses a vertical sliding valve arm activated by the camshaft to close an engine valve and a valve spring to open the valve. In one non-limiting example, the invention may be configured as illustrated in FIG. 1, which shows the preferred embodiment with the sliding arm mounted on the cylinder head 6 with a conventional-type valve spring 13 located above the sliding arm 2. The spring is held in place by a valve retainer 12. The valve retainer 12 is held in place by body and housing 27, which is attached to threaded stein 28 of sliding arm post 3. The operation is described as follows. As camshaft 9 turns, it pushes up on lifter 8 and also pushes up on pushrod 7 that is guided by a pushrod guide plate 4. The end of pushrod 7 fits into the socket of pushrod piston 20, which slides in bore 22. As the pushrod 7 rises, pushrod piston 20 contacts compressible material 21, which can be a compressible material 21 such as rubber. The compressible material 21 dampens the closing of the engine valve 10 as it closes on its seat in cylinder head 6. It also serves to dampen the camshaft lift and provide temporary dwell to aid in the camshaft duration.

Sliding arm 2 is connected to engine valve 10 by valve locks 35 housed in cavity 25 of sliding arm 2. Therefore, as sliding arm 2 rises, it closes engine valve 10 and compresses valve spring 13. As the camshaft 9 continues to rotate, it moves to the base or the lowest point of its lobe, allowing pushrod 7 to lower and allowing the compressed valve spring 13 to expand, pushing down on the sliding arm 2 and lowering the attached valve 10 to an open position. As the camshaft 9 continues to rotate, it repeats the cycle again. The engine's oil passing through the pushrod flows through passage 5 to lubricate the bushing 18 on the sliding arm post 3. This arrangement makes it practically impossible to float engine valves at high rpm, and impossible for the engine valve 10 to strike and damage the engine pistons as a result of the valve float. Thus, the spring no longer closes the valve the way it does in a conventional type valve train engine. Instead, it is closed through the positive force of the pushrod 7 to the sliding arm 2 in this invention.

Figure 2:
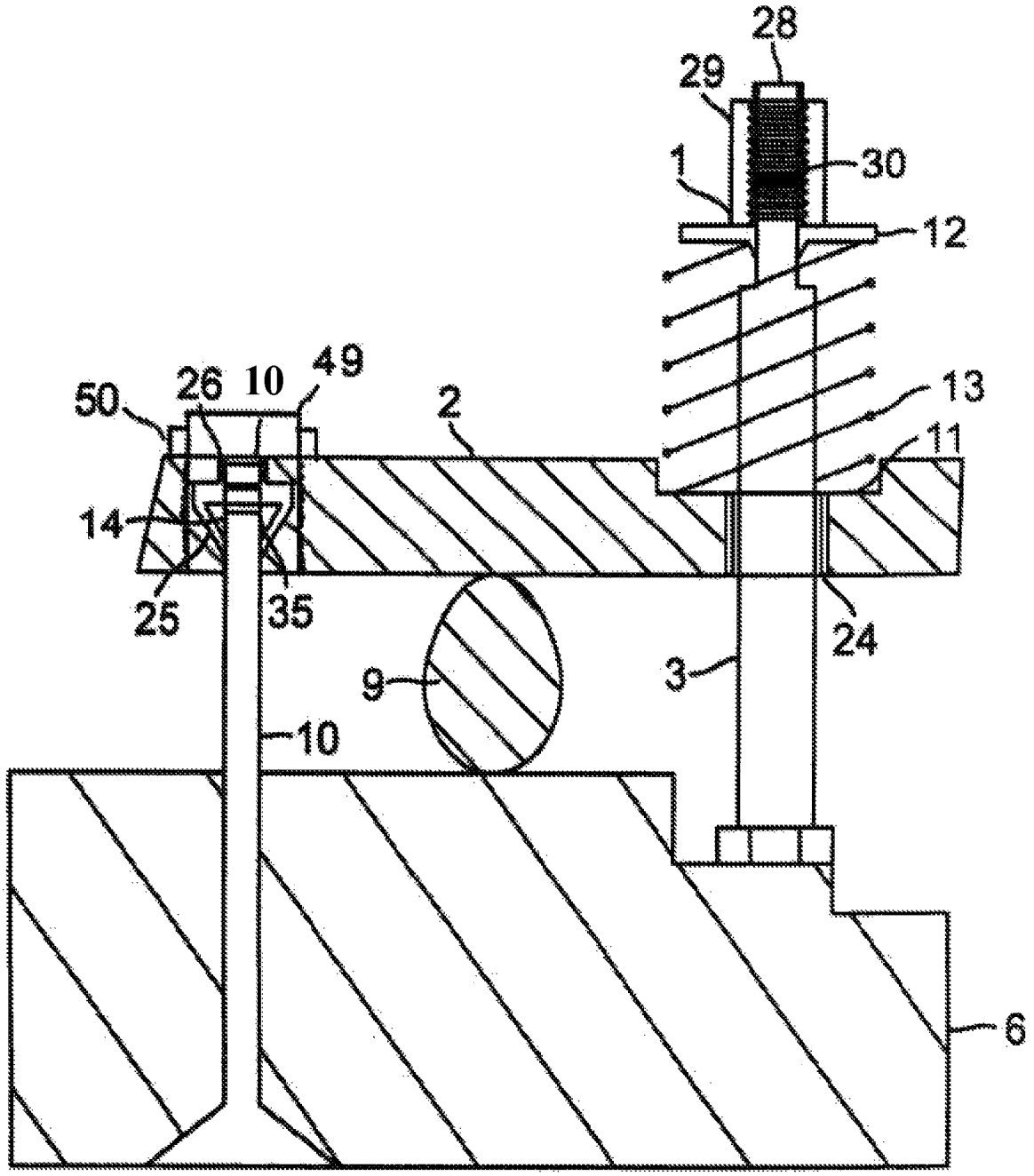
FIG. 2 Shows an alternative method of the embodiment.

FIG. 2 shows an alternative method of the embodiment. The sliding arm 2 on an overhead valve type engine operates as follows. As camshaft 9 turns, the lobes contact and pushed up sliding arm 2. At the same time, the camshaft 9 pushes up attached engine valve 10 that is attached by valve locks 35 and is housed in cavity 25 of the sliding arm 2. The engine valve 10 can be adjusted to secure a tight proper valve closure by turning pushrod adjustment screw body 50. Inside the body is a cavity 25 and valve locks 35 that the body 50 screws into sliding arm 2 which is secured by fastener(s).

As the sliding arm 2 rises, the sliding arm 2 closes valve 10 and compresses valve spring 13. As the camshaft continues to rotate, the camshaft moves to the base or lowest point of the lobe, allowing the sliding arm 2 to lower and allowing compressed valve spring 13 to expand, and push down on the sliding arm 2 and lower the attached valve 10 to an open position. As the camshaft 9 continues to rotate it repeats the cycle again.

Figure 3:
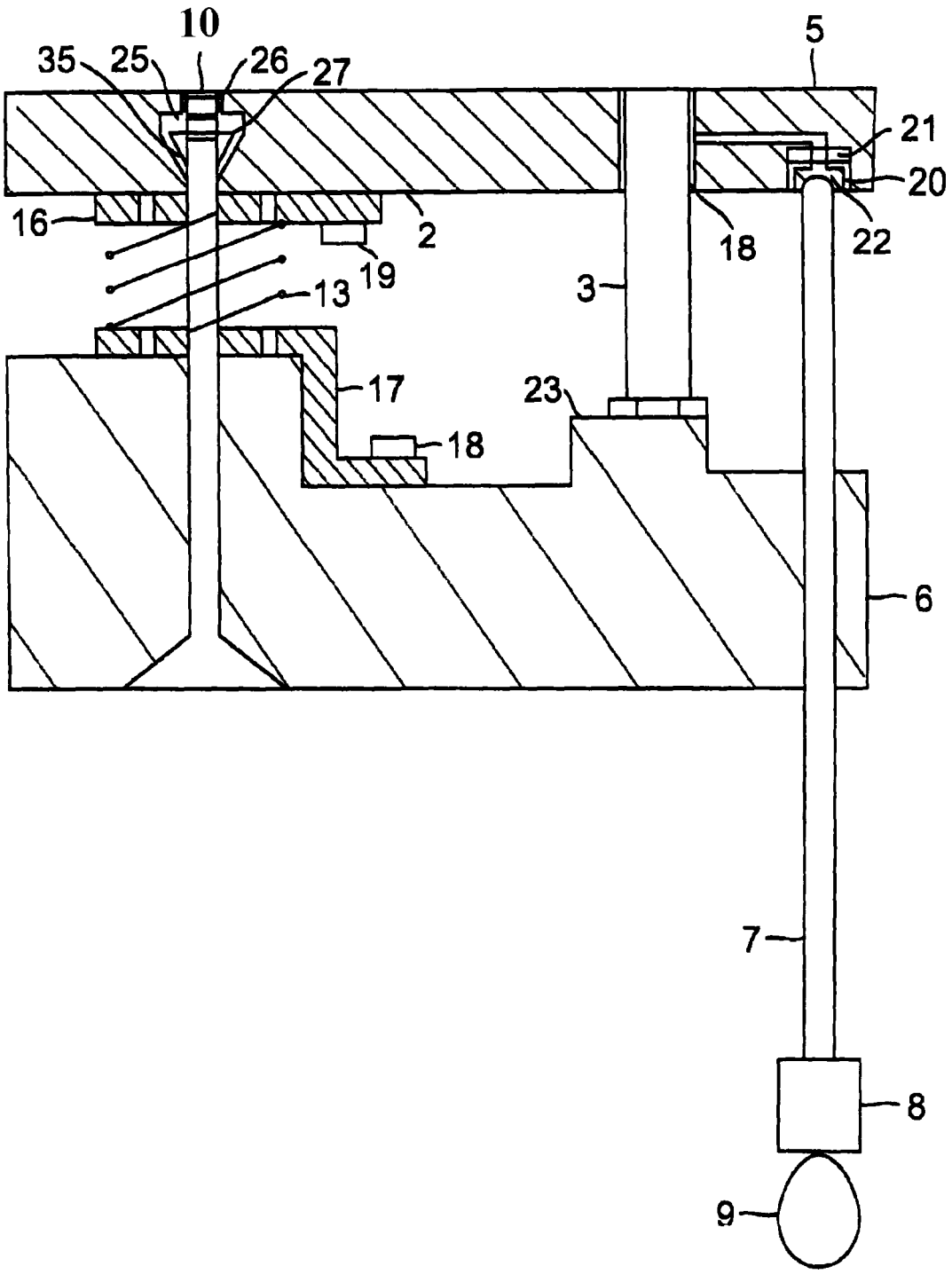
FIG. 3 shows a third alternative method of the embodiment.

FIG. 3 shows a third alternative method of the embodiment. It is a variation of FIG. 1 with the valve spring 13 mounted below the sliding arm 2 when used in a spring expansion arrangement. The operation is described as follows. As camshaft 9 turns, it pushes up lifter 8 and also pushes up on pushrod 7. The end of pushrod 7 fits into the socket of pushrod piston 20, which slides in bore 22. As the pushrod 7 rises, pushrod piston 20 contacts compressible material 21, such as rubber. The compressible material 21 dampens the closing of the engine valve 10. As the engine valve 10 closes on its seat in cylinder head 6, it also serves to dampen the camshaft 9 lift and provide temporary dwell to aid in the camshaft 9 duration. Sliding arm 2 is connected to engine valve 10 by valves locks 35 housed in cavity 25 of sliding arm 2. Therefore, as the sliding arm 2 rises, it closes engine valve 10 and expands valve spring 13.

As the camshaft 9 continues to rotate, it moves to the base or the lowest point of its lobe, allowing pushrod 7 to lower and allowing the compressed valve spring 13 to retract, pulling down on the sliding arm 2 and lowering the attached valve 10 to an open position. As the camshaft 9 continues to rotate it, repeats the cycle again. The engine's oil passing through the pushrod 7 via the valve lifter 8 flows through passage 5 and into bushing 18 to lubricate it. This arrangement makes it practically impossible to "float" at high engine rpm, and impossible for the valve to strike and damage the engines pistons. "Valve float" or valves staying open for too long due to valve spring oscillations or weak valve spring function. Because the engine valves 10 are no longer opened by the camshaft and closed by the valve springs as in a conventional engine, valve float is avoided. Instead, the valves with this invention are closed by the positive force of the pushrod to the sliding arm.

Figure 4:
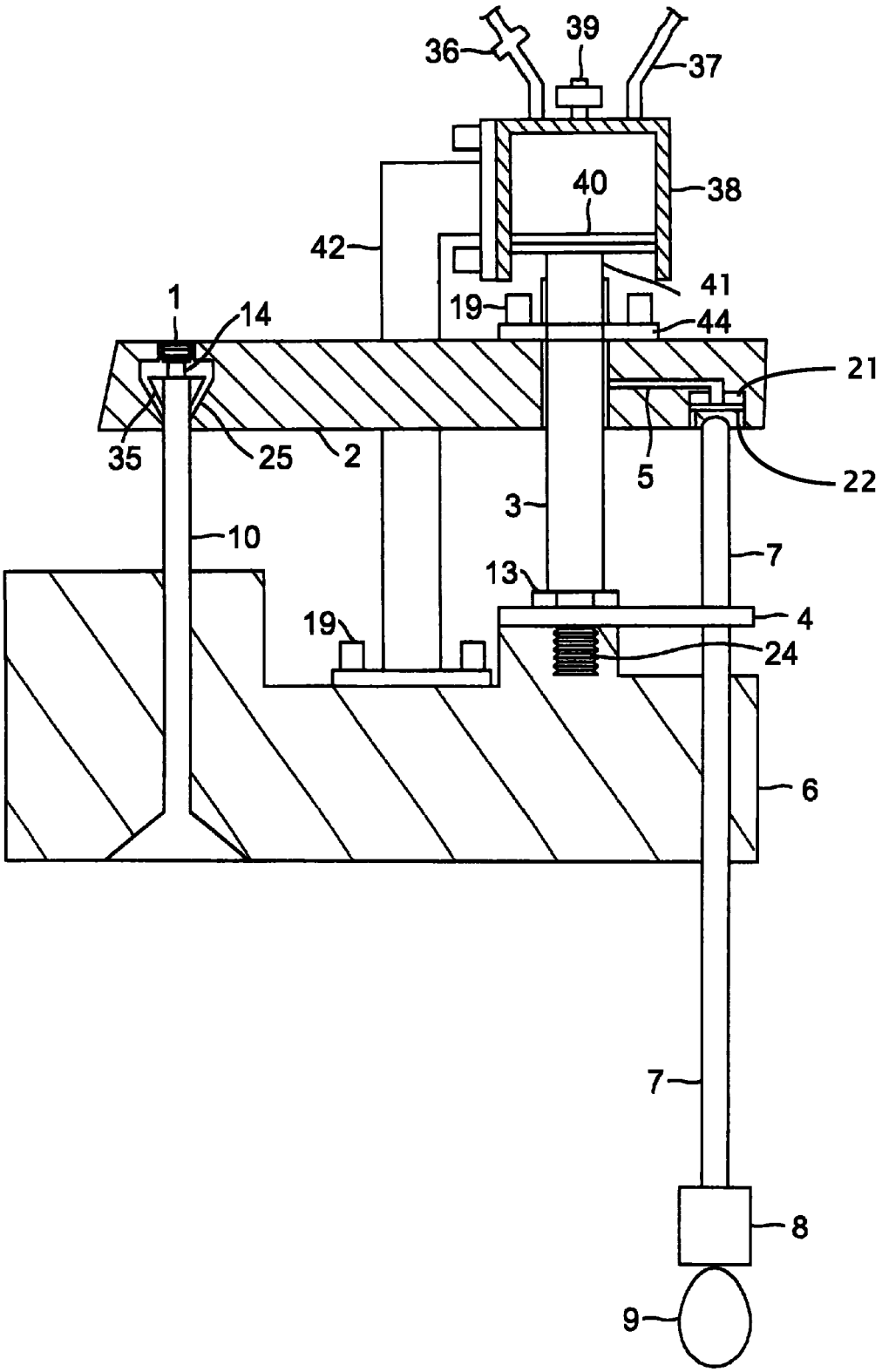
FIG. 4 shows the sliding arm with an air cushion cylinder replacing the valve spring depicted in other embodiments.

FIG. 4 shows the sliding arm 2 with an air cushion cylinder 38 replacing the valve spring depicted in other embodiments. As camshaft 9 turns, it pushes up lifter 8 while pushing on pushrod 7, which fits into pushrod piston bore 22 of siding arm 2, causing the pushrod 7 piston to push against the pushrod piston cushion which is a compressible material 21 such as rubber. As the pushrod 7 rises, the pushrod 7 lifts piston rod 41, which is attached to sliding arm 2 with fasteners 19. As the sliding arm piston rod rises it pushes on piston 40, which is housed in cylinder 38, thereby compressing the air above it to create an air spring. As camshaft 9 continues to rotate to the high point of its lobe, it lifts sliding arm 2 and also lifts valve 10 attached on the other end of the arm 2 and is attached by valve locks 35 and housed in cavity 25 of sliding arm 2.

As sliding arm 2 rises, it lifts attached valve 10 and closes valve 10 on valve seat in cylinder head 6. As the camshaft continues to rotate, it moves to the low point of its lobe and the lifter 8 descends and lifter 8 is lowered and compressed air in cylinder 38 begins to decompress, thus putting pressure on piston rod 41. The pressure forces sliding arm 2 down. Lowering pushrod 7 and lifter 8 while staying in contact with the lobes on camshaft 9 while the engine lowers to the open position in cylinder head 6.

The air in the cylinder 38 over time may lose air due to air leakage so an auxiliary air supply via an air pump may be required for replenishing the air that would enter supply line 37. Pressure is regulated by regulator/relief valve 39 and air may be drawn in through supply line 37 and check valve 36.

Figure 5:
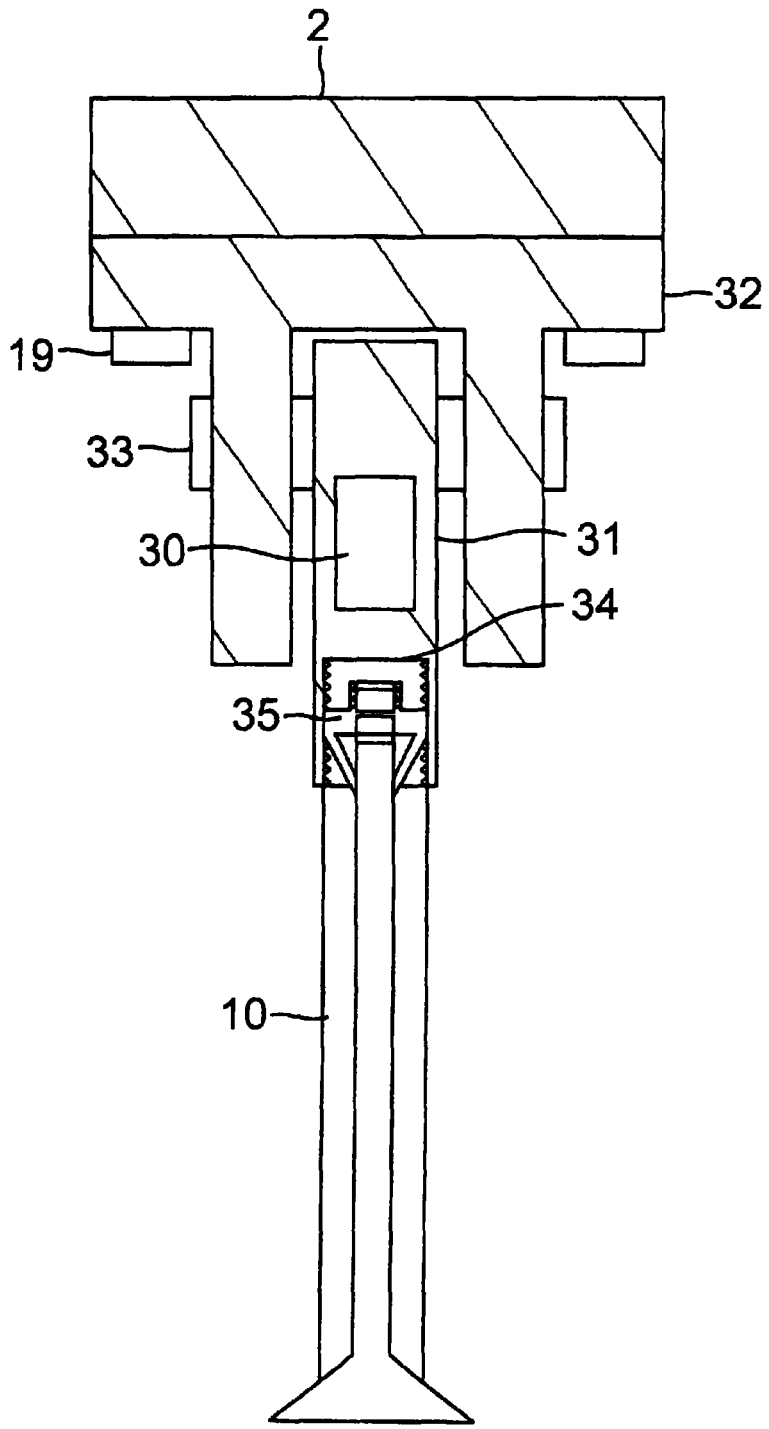
FIG. 5 illustrates the pivot connection between the valve and sliding arm, which appear on some embodiments.

FIG. 5 illustrates the pivot connection between the valve 10 and sliding arm 2, which appear on some embodiments. Sliding arm 2 is attached to pivot valve holder 31, secured by fasteners 19 inside the holder. Valve adapter and trunnion adapter 32 are supported by trunnion bearings 33. The engine valve stein is secured by valve locks 35 housed in pivot valve holder 31, thus creating the ability for pivot of engine valve 10 as sliding arm 2 moves or pivots.

Figure 6:
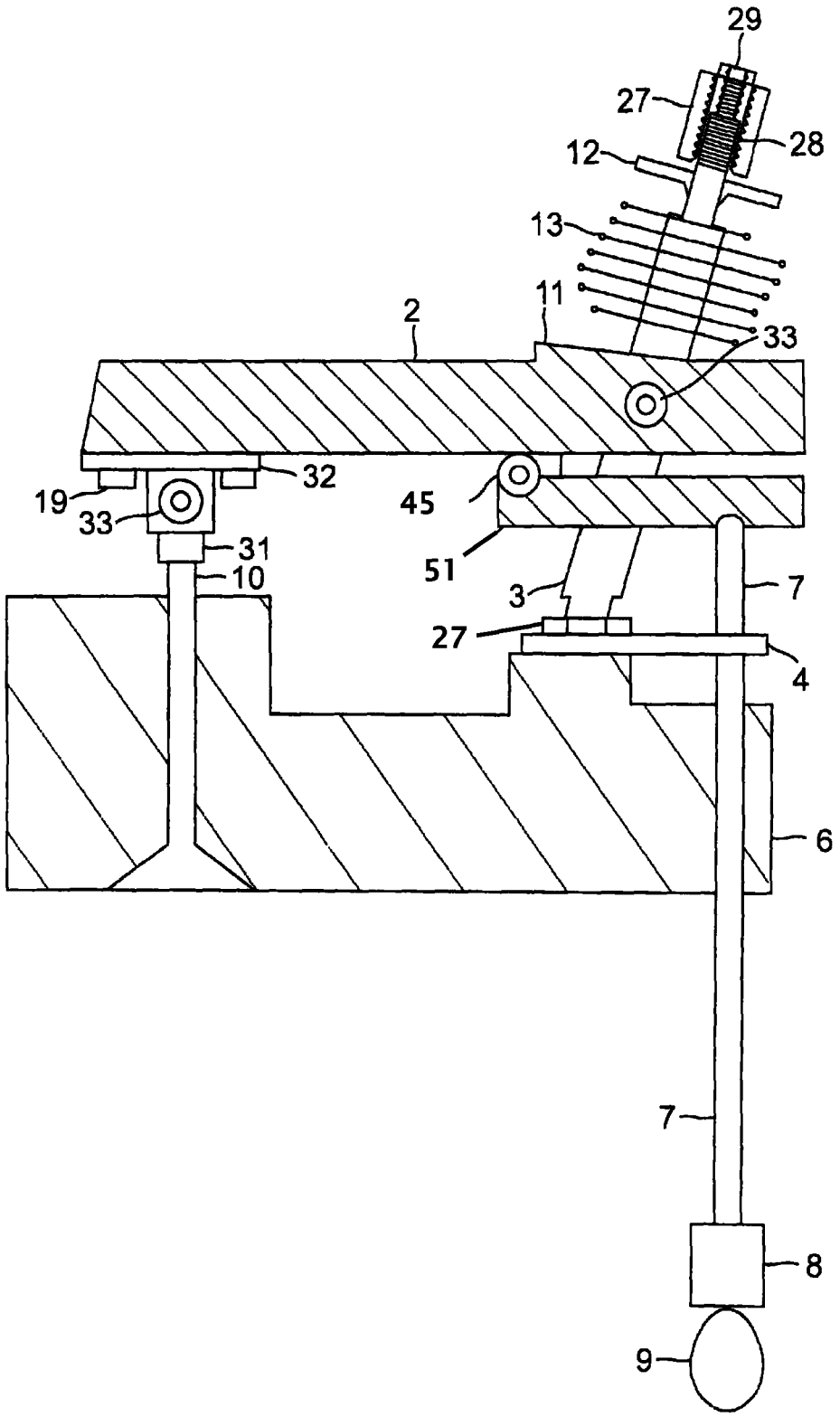
FIG. 6 illustrates a pivoting lever with a sliding roller arm.

FIG. 6 illustrates a pivoting lever with a sliding roller arm under it and operates as follows. As camshaft 9 turns, it pushes up lifter 8 while pushing on pushrod 7, which fits into pushrod piston socket of sliding arm roller 51. This causes the pushrod piston to push against the pushrod piston cushion, which is a compressible material such as rubber. As pushrod 7 rises, it lifts sliding arm roller 51, which slides on sliding arm post 3, causing the attached pivot roller 45 to contact and lift sliding arm 2, which rises. Sliding arm 2 is attached to pivot roller 45, which is anchored to sliding arm post 3. As the pivot arm pivots moves up, it lifts the attached pivot valve holder 31 and attached engine valve 10, which is connected through pivot valve holder 31. This holder is held by trunnion adapter 32.

As sliding arm 2 rises, it causes engine valve 10 to close on its seat in cylinder head 6. As the camshaft continues to rotate to the base or the lowest point of its lobe, pushrod 7 starts to descend down and the valve spring 13 begins to decompress, forcing pivot arm 2 and roller slide arm pivot roller 45 to cause pushrod 7 to lower on lifter 8 while lowering engine valve 10 to an open position in cylinder head 6. The different lengths between the pivot roller 45 and trunnion roller 33 could be varied. This ratio of leverage can be varied to give a mechanical advantage to the amount of lift to engine valve 10, similar to the pivot rocker arm rations commonly used on conventional engines. As the camshaft continues to rotate, the above-mentioned cycle occurs again.

Figure 7:
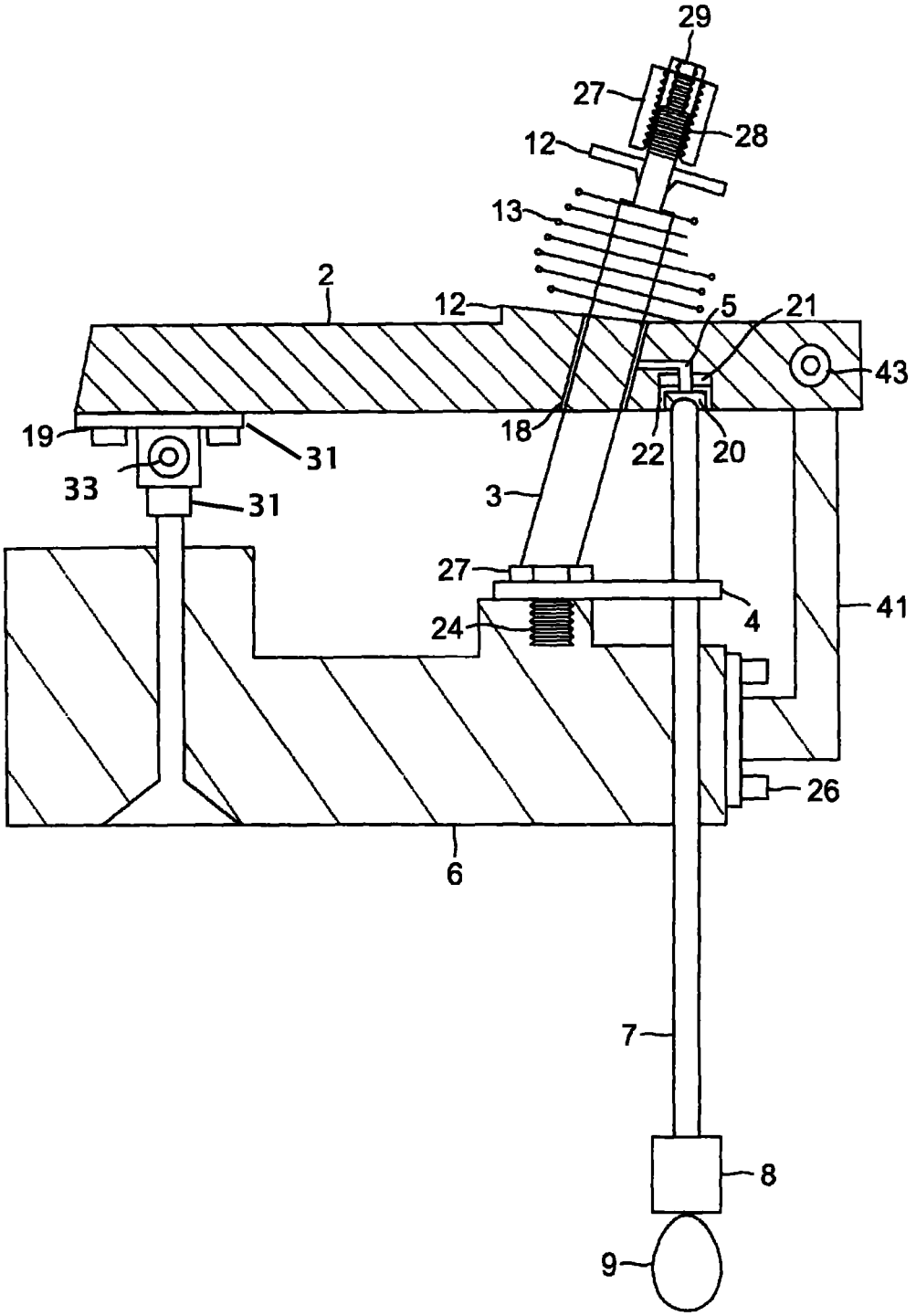
FIG. 7 illustrates a pivoting lever type arm.

FIG. 7 illustrates a pivoting lever type arm and operates as follows. As camshaft 9 turns, it pushes up lifter 8 and pushes on pushrod 7, which fits into pushrod socket pushrod piston 20. This piston slides in bore 22 as the pushrod 7 rises. Pushrod piston 20 contacts compressible material 21, such as rubber. The compressible material 21 dampens the closing of the engine valve 10. As it closes on its seat in cylinder head 6, it also servers to dampen the camshaft lift and provide temporary dwell to aid in the camshaft duration. Sliding arm 2 rises and is connected to pivot valve holder 31 and it pivots on trunnion 33. This trunnion 33 is held by trunnion adapter 32, which is attached to cylinder head 6 with fasteners 19 of the lever in sliding arm 2.

As the camshaft 9 continues to rotate to the base or the lowest point of its lobe, pushrod 7 starts to descend down and valve spring 13 begins to decompress, forcing pushrod 7 to lower on lifter 8 while also lowering engine valve 10 to an open position in the cylinder head 6. The length between the pushrod contact point of sliding arm 2 and the pivot roller 45 on the pivot arm 2 could be varied. This ratio of leverage can be varied to give a mechanical advantage to the movement engine valve 10, similar to the pivot rocker arm ratios commonly used on engines. As the camshaft continues to rotate, it repeats the above-mentioned cycle again.

Figure 8:
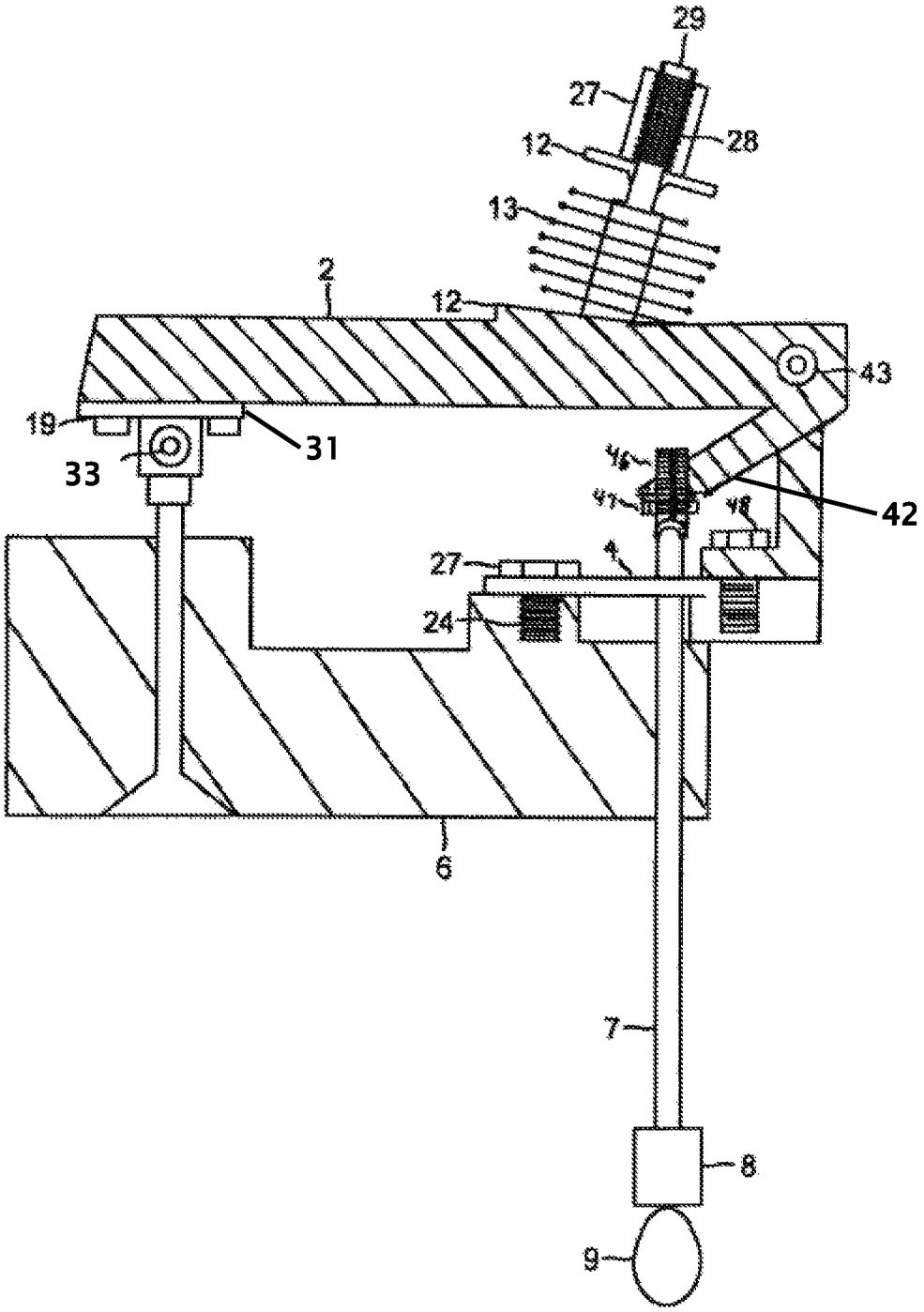
FIG. 8 illustrates a pivoting lever type arm.

FIG. 8 illustrates a pivoting lever type arm and operates as follows. As camshaft 9 turns, the camshaft 9 pushes up lifter 8 on pushrod 7 which fits into pushrod cap of adjusting screw 46 and is secured by fastener 47. The pushrod 7 pushes up on the extended part of sliding arm 2. As sliding arm 2 rises, the sliding arm 2 is connected to pivot valve holder 31 that pivots on trunnion 33. This trunnion 33 is held with fasteners 19 of the lever in sliding arm 2.

As the camshaft 9 continues to rotate to the base or the lowest point of the its lobe, pushrod 7 starts to descend down and valve spring 13 begins to decompress, forcing pushrod 7 to lower on lifter 8 while also lowering engine valve 10 to an open position in the cylinder head 6. The length between the pushrod contact of sliding arm 2 and the pivot roller 43 on the pivot arm 42 could be varied. This ratio of leverage can be varied to give a mechanical advantage to the movement of engine valve 10, similar to the pivot rocker arm ratios commonly used on engines. As the camshaft continues to rotate, the above-mentioned cycle repeats again.

The foregoing description, for purposes of explanation, has been described with reference to specific embodiments. However, the illustrative discussions above are not intended to be exhaustive or to limit the invention to the precise forms disclosed. Many modifications and variations are possible in view of the above teachings without departing from the spirit and the scope of the description. The embodiments were chosen and described in order to best explain the principles of the invention and its practical applications, to thereby enable others skilled in the art to best utilize the invention and various embodiments with various modifications as are suited to the particular use contemplated. Alternate embodiments are also included within the scope of the disclosure. In these alternate embodiments, functions may be executed out of order from that shown or discussed, including substantially concurrently or in reverse order, depending on the functionality involved. Not all steps are required in all embodiments.

Thus, specific embodiments of a vertical sliding valve arm have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A system of valve actuation by way of a rotating camshaft comprising:

a rotating cam pushing up on a valve lifter and a pushrod to contact a horizontal sliding arm;

said pushrod is pivotably connected to an arm on said horizontal sliding arm;

the horizontal sliding arm contacts the pushrod on a first end of the horizontal sliding arm and is lifted by the pushrod;

an engine valve is attached on the other end of the horizontal sliding arm, whereby a rise and a fall of the horizontal sliding arm opens and closes the engine valve;

a spring is mounted on top of the horizontal sliding arm between the pushrod and the engine valve such that when the horizontal sliding arm rises, it compresses the spring and when the horizontal sliding arm is lowered, the spring becomes uncompressed and provides a force to open the engine valve and also provides a second force to keep the valve lifter in contact with the rotating cam.

2. The system of valve actuation by way of a rotating camshaft according to claim 1, wherein the spring is supported on a sliding arm post.

3. The system of valve actuation by way of a rotating camshaft according to claim 2, wherein the sliding arm post is secured into a cylinder head.

4. The system of valve actuation by way of a rotating camshaft according to claim 3, further includes a bushing between the horizontal sliding arm and the sliding arm post.

5. The system of valve actuation by way of a rotating camshaft according to claim 2, wherein the sliding arm post has a threaded stem.

6. The system of valve actuation by way of a rotating camshaft according to claim 1, wherein a threaded stem is configured to allow for compression of the spring.

7. The system of valve actuation by way of a rotating camshaft according to claim 1, wherein the horizontal sliding arm includes a bore for the pushrod.

8. The system of valve actuation by way of a rotating camshaft according to claim 7, wherein the bore includes a compressible material between the pushrod and the horizontal sliding arm.

9. The system of valve actuation by way of a rotating camshaft according to claim 7, further includes an oil passage that passes oil though said pushrod.

10. The system of valve actuation by way of a rotating camshaft according to claim 1, wherein the engine valve is connected to the horizontal sliding arm with a valve lock.

11. The system of valve actuation by way of a rotating camshaft according to claim 10, wherein the valve lock raises and lowers the engine valve with the horizontal sliding arm.

12. The system of valve actuation by way of a rotating camshaft according to claim 1, wherein an end of the engine valve is retained in a cavity of the horizontal sliding arm.

13. The system of valve actuation by way of a rotating camshaft according to claim 1, wherein the pushrod passes through a pushrod guide plate.

14. The system of valve actuation by way of a rotating camshaft according to claim 13, wherein the pushrod guide plate is secured by a sliding arm post.

15. The system of valve actuation by way of a rotating camshaft according to claim 1, wherein said spring is an air cushion cylinder.

16. The system of valve actuation by way of a rotating camshaft according to claim 15, wherein said air cushion cylinder has at least one of a relief valve, a supply line and a check valve.

17. The system of valve actuation by way of a rotating camshaft according to claim 1, wherein said engine valve is supported on trunnion bearings.

18. The system of valve actuation by way of a rotating camshaft according to claim 1, wherein said horizontal sliding arm pivots on a pivot roller.

* * * * *